United States Patent [19]

Ostermann et al.

[11] Patent Number: 4,886,713

[45] Date of Patent: Dec. 12, 1989

[54] DEEP DRAWABLE ALUMINUM SHEET OR STRIP

[75] Inventors: Friedrich Ostermann, Meckenheim-Merl; Christian Dumont, Bornheim; Rainer Balbach, Massenbachhausen; Gerhard Sollner, St. Augustin, all of Fed. Rep. of Germany

[73] Assignee: Vereingte Aluminum-Werke Aktiengesellschaft, Bonn, Fed. Rep. of Germany

[21] Appl. No.: 185,537

[22] Filed: Apr. 25, 1988

[30] Foreign Application Priority Data

Apr. 25, 1987 [DE] Fed. Rep. of Germany ..... 3713909

[51] Int. Cl.[4] ..... B32B 15/00

[52] U.S. Cl. ..... 428/687; 72/365; 148/437

[58] Field of Search ..... 428/687; 148/437–440; 72/365

[56] References Cited

U.S. PATENT DOCUMENTS 4,634,475 1/1987 Fishcher ..... 148/437

*Primary Examiner*—R. Dean

*Attorney, Agent, or Firm*—Darby & Darby

[57] ABSTRACT

A deep drawable sheet or strip of metal, preferably aluminum or an aluminum alloy having a surface treated for deep drawing characterized in that the surface has a microroughness, Ra, ranging between about 0.1 and 0.8 μm and a uniform, honeycomb-shaped structure, wherein the honeycomb diameter ranges between about 20 μm and about 200 μm is provided.

12 Claims, 2 Drawing Sheets

DEEP DRAWABLE ALUMINUM SHEET OR STRIP

BACKGROUND OF THE INVENTION

The present invention is related to a deep drawable sheet or strip of metal, preferably aluminum or an aluminum alloy having a surface treated for deep drawing and a method for the manufacture of such a sheet or strip.

A deep drawable sheet metal is known from German patent application DE-OS 30 08 679. Due to the roughing methods employed in its manufacture, the sheet has an irregular microroughness (Ra) of approximately 0.8 to 5 μm with primarily slender peaks finely distributed over the surface of the metal. The irregularity refers to the height and diameters of the peaks in the distance and the outline of the depressions in the surface, respectively. In connection with the holding-down clamp employed to produce the sheet, the depressions are intended to be sealed off during deep drawing, so that the lubricant filling which is taken up remains enclosed (see column 3, line 60 of the '679 patent).

In order to achieve the above-described effect, the roll surface is roughened by sand blasting (in the method according to German patent application DE-OS 30 08 679) and an undesirable microsurface is produced through rerolling of the sheet or the strip.

In the case of the deep drawable sheet or strip according to DE-OS 30 08 679 roughened in the manner described above, the depressions for the lubricant are arranged staggered with respect to each other. However, under closer investigation it can be seen that the microdepressions are connected with each other, so that the lubricant filling that is taken up can flow off laterally. This can cause folds and/or tears at the sites which are exposed to the greater stresses of the drawing operation.

What is needed in the art is a method for deep drawing a metal sheet or strip of aluminum or of an aluminum alloy having a hydrodynamic pressure structure (in terms of the lubricant) in the compression gap between the tool surface and sheet roughness peaks in order to improve the slide properties in the drawing tool and to decrease the tensile force required by at least 30% compared to conventional surfaces. Products produced by deep drawing sheets or strips of aluminum using the method of the present invention include automobile parts, beverage cans and plates.

Therefore, it is an object of the present invention to provide a method for deep drawing a sheet or strip metal which overcomes the above-mentioned drawbacks in the prior art techniques.

This and other objects of the present invention will be apparent to those of ordinary skill in the art in light of the present description, accompanying claims and appended drawings.

SUMMARY OF THE INVENTION

The present inventors have discovered a method for the production of a deep drawable sheet metal or strip of aluminum or aluminum alloy. In one aspect, the present invention provides a deep drawable sheet metal, strip or similar non-iron metal or alloy, in particular that of aluminum, with a surface pretreated for deep drawing, having a surface microroughness (Ra) ranging between about 0.1 and about 0.8 μμm, and a uniform, honeycomb-shaped structure. The sheet is deep drawable, stretch-formable and ironable.

In another aspect, the present invention provides a method for the manufacture of a deep drawable, stretch-formable, and ironable sheet metal, strip or similar type material which comprise rolling said sheet or strip in a rolling mill including a roller having a microroughness surface and reducing the gauge of said sheet or strip by at least about 6% in said rolling operation.

Another aspect of the present invention provides a method for manufacturing a deep drawable, stretch-formable and ironable aluminum sheet or strip comprising the steps of providing a sheet or strip comprising aluminum or an aluminum alloy and having a first thickness, and rolling the sheet or strip down to a second thickness that is at least 6% smaller than the first thickness.

DETAILED DESCRIPTION OF THE INVENTION

Figure 1:
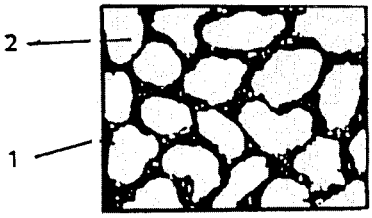
FIG. 1 shows the microsurface of the deep drawable sheet according to the present invention.

The present invention provides a deep drawable sheet or a deep drawable strip. The sheet has a hydrodynamic pressure structure in the compression gap between the tool surface and sheet roughness peaks. In this way, the slide properties in the drawing tool are improved and the tensile force is decreased by at least 30% compared to conventional surfaces.

As used herein, roughness is defined as the relatively finely spaced irregularities on the surface of the metal sheet or strip. The height, width and direction of these irregularities establish the surface pattern of the metal sheet or strip. Ra is the universally recognized parameter of roughness. It is the arithmetic mean of the departures of the surface profile from the mean line.

Almost all aluminum alloys can be used in practicing the present invention as long as they have moderate or good formability properties. Preferred aluminum alloys for use in the present invention include, but are not limited to, the 3xxx, 5xxx and 6xxx aluminum alloy groups. All of these groups have a good formability, especially in the O-Temper, and excellent hardening properties when cold worked (the 5xxx alloy group) and heat tempered (the 6xxx alloy group). Alloys of the 3xxx alloy group (for example AA3004) are particularly preferred for the manufacturing of beverage cans.

The present inventors have found that a desirable microstructure of the surface of the deep drawable sheet or strip used in the present invention comprises a cell structure which is in a honeycomb-like form. A particularly preferred surface microstructure for avoiding fold and tear formation can be achieved by a uniform honeycomb structure and a honeycomb density of between about 10 honeycombs per $mm^2$ and about 250 honeycombs per $mm^2$. In the preferred range the metal surface has a microstructure containing between about 100 honeycombs per $mm^2$ and 140 honeycombs per $mm^2$. In this range a particularly high tensile reserve of at least 28% is provided, with the honeycomb structures having diameters ranging between about 20 μm and about 200 μμm, and preferably between about 80 μm and about 100 μm. The diameter of the honeycomb corresponds to the diameter of the circle encompassing the honeycomb-shaped structure defined by the surface irregularities.

The microsurface produced according to the present invention (in terms of the honeycomb structure) is generated by passing the metal sheet or strip between appropriately prepared rolls with a degree of reduction of greater than 6% in the last cold reduction pass. The thus manufactured aluminum sheets or strips are suitable for deep drawing, stretch-forming and ironing of all types of alloys of aluminum.

In order to manufacture the roll or sheet used in practicing the present invention, the roll surface is first roughened by applying a concentrated corpuscular beam, such as a laser or an electron beam, to the roll surface in order to provide controlled roughness to the surface of the roll. This roughening of the surface of the rolls may be provided according to the process disclosed in U.S. Pat. No. 4,628,179 (the disclosure of which is incorporated by reference herein).

Two rolling processes are possible to produce the roll sheet or strip of the present invention. In the first process, rolling down to the end gauge with rolls roughened according to U.S. Pat. No. 4,628,179 can be employed. Although this embodiment of the present invention is inconvenient in that a lower rolling speed is used due to a higher abrasion losses, it produces no changes in the rolls during the rolling process. A particularly preferred embodiment employs rolling down to an intermediate gauge with conventional rolls (e.g. with mill finished surfaces), and for the last pass, rolling down to the end gauge with roughened rolls so that the degree of reduction of the finished product is greater than about 6 percent. With the greater than 6 percent reduction, the honeycomb-like surface structure of the strip of the present invention is produced.

FIG. 1 shows the microsurface of the deep drawable sheet manufactured according to the present invention. In FIG. 1 the bearing surface of the honeycomb structure is indicated by 1 and the lubricant filling by 2. It can be seen that the honeycomb surface structure forms a lubricant pocket in which the lubricant is enclosed on all sides.

Figure 2:
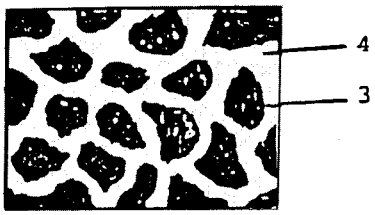
FIG. 2 is a comparison surface manufactured according to prior art techniques.

FIG. 2 shows the microsurface of a sheet surface manufactured with a roll treated by prior art sand blasting techniques. The bearing roughness peaks 3 are surrounded by lubricant 4, which can flow off laterally into channel-like openings. A stable pressure structure is not brought about in this way, since the lubricant film is not formed with constant uniformity and tears at the sites which are exposed to greater stress.

Figure 3:
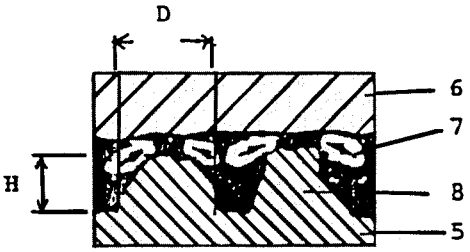
FIG. 3 is the compression flow between tool and sheet in a sheet deep drawn according to the present invention.

FIG. 3 shows the compression flow between tool and sheet in a sheet deep drawn according to the present invention. In FIG. 3, a cross-section through the deep drawable sheet manufactured according to the present invention 5 and a holding-down clamp 6 in the region of the deformation zone is shown. Through the relative motion between sheet and tool, a hydrodynamic pressure is built-up in the gap 8 between sheet 5 and holding-down clamp 6. The compression flow of the lubricant is indicated by arrows 7.

In FIG. 3, H is the honeycomb height and D is the wall thickness which corresponds to the distance between honeycomb cells. In a preferred embodiment of the present invention, the ratio of H:D is about 1.2:1. In addition, the wall thickness varies over the entire honeycomb-shaped structure of the sheet by ±5%, demonstrating its regularity.

The present invention is described below in specific examples which are intended to describe the present invention without limited its scope.

EXAMPLE 1

Figure 4:
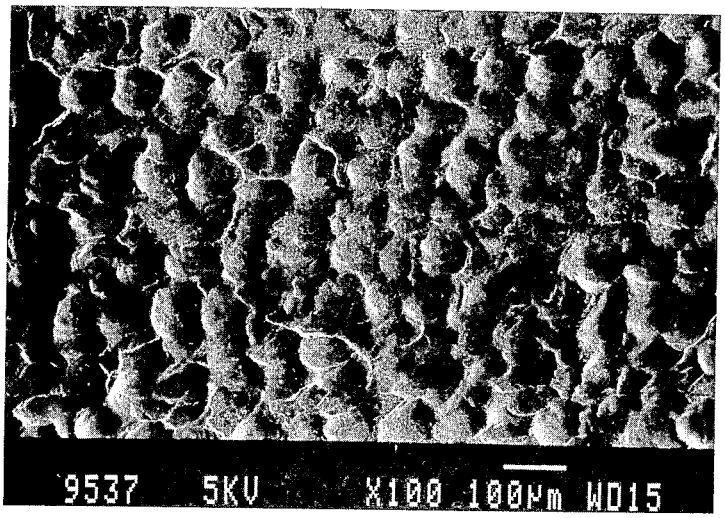
FIG. 4 is a raster electron micrograph showing the surface of the sheet produced according to the present invention.
Figure 5:
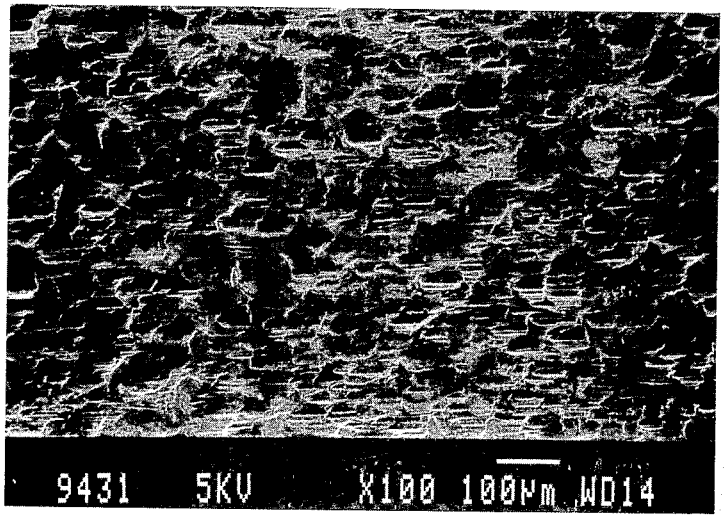
FIG. 5 is a raster electron micrograph of a sheet manufactured according to prior art techniques.
Figure 6:
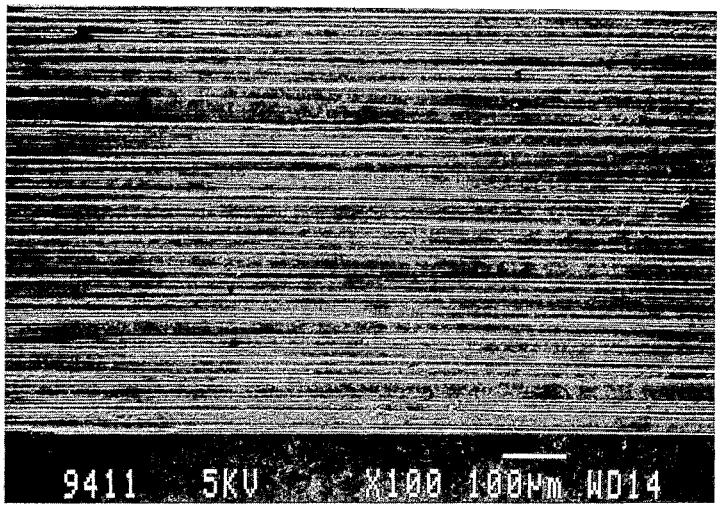
FIG. 6 is a raster electron micrograph of the surface of a standard sheet (mill finish).

The present inventors have conducted a comparison investigation between the deep drawable sheet with a honeycomb-like structure of the alloy AlMg5Mn manufactured according to the present invention, a comparison sheet manufactured according to DE-OS 30 08 679, and a sheet manufactured with ground rolls (mill finish) of the same alloy. The particular surfaces produced were recorded in photographs with a raster electron microscope. In FIGS. 4 through 6 below the scale is 1:100.

FIG. 4 shows the surface of the sheet produced according to the present invention demonstrating its honeycomb-like structure.

FIG. 5 shows the irregular surface of a sheet of AlMg5Mn alloy manufactured by prior art processes, while FIG. 6 shows the same alloy produced with a standard sheet (mill finish). The latter two photomicrographs show the lack of the regular honeycomb-like structure shown in FIG. 4.

The aluminum alloy AlMg5Mn (standard AA 5182), with a sheet thickness of 1.25 mm in the soft state was produced. Three sheet surfaces were produced having (1) the irregular structure of DE OS 30 08 679; (2) the honeycomb surface of the sheet manufactured according to the present invention and (3) the mill finish for a sheet produced with ground rolls were examined. Table 1 below shows the properties of these various materials.

TABLE 1

| Sheet Surface | (1) Irregular Structure OS 30 08 679 | (2) Honeycomb according to the invention | (3) Structure mill finish |
|---|---|---|---|
| Ra (μm) parallel to rolling direction | 1.07 | 0.80 | 0.13 |
| Ra (μm) perpendicular to rolling direction | 1.07 | 0.72 | 0.38 |
| Drawing reserve (%)[1] | 22 | 28 | 18 |
| Tensile force (kN) | 120 | 90 | 120 |

[1]Engelhardt, W.: Development and first evaluation of a new method for the evaluation of deep drawability, Dissertation, Technical University, Dresden, 1961

In Table 1, the surface roughness (Ra) according to DIN 4768, measured parallel to the direction of rolling, the surface roughness perpendicular to the direction of rolling, the drawing reserve and the tensile force are presented.

Cups with bowl-shaped bottoms having a diameter of 125 mm were produced. The results presented in Table 1 show the surprising properties of the sheet produced according to the present invention that have a 6% increase in their drawing reserve and a decrease of tensile force by 30 kN (kN=kilonewton; 1 kN=22.48 lbs). In terms of the former, increasing the drawing reserve means that less force is required in the deep drawing process. This reduces the tearing rate in drawn parts especially in parts having complex forms. The decrease in the tensile force allows for a reduction in the energy required in the process and reduces costs due to the fact that a smaller drawing press may be used.

The present invention has been described in reference to preferred embodiments. It would be apparent to one skilled in the art that many additions, substitutions, and deletions can be made without departing from the spirit and scope of the invention as claimed below.

What is claimed is:

1. A deep drawable sheet, or a strip made of aluminum or an aluminum alloy comprising an outside surface pretreated for deep drawing, said outside surface having a microroughness, Ra ranging between about 0.1 and about 0.8 μm and having a uniform, honeycomb-shaped structure, wherein a honeycomb diameter ranges between about 20 μm and about 200 μm.

2. The deep drawable aluminum sheet of claim 1, wherein said diameter ranges between about 80 μm and about 100 μm.

3. The deep drawable aluminum sheet of claims 1, wherein the honeycomb shaped structure is formed by a honeycomb wall with the constant honeycomb height H, and the wall thickness D with D with ratio of H:D=1.2:1.

4. The deep drawable aluminum sheet of claim 3, wherein the wall thickness D, corresponding to the honeycomb distance, varies over the entire honeycomb-shaped structure of the sheet by plus or minus 5%.

5. The deep drawable aluminum sheet of claim 1, wherein the honeycomb density ranges between about 10 honeycombs per $mm^2$ and 250 honeycombs per $mm^2$.

6. The deep drawable aluminum sheet of claim 5, wherein said honeycomb density ranges between about 100 honeycombs per $mm^2$ to 140 honeycombs per $mm^2$.

7. A method for manufacturing a deep drawable, stretch-formable and ironable aluminum sheet or strip which comprises:

providing a sheet or strip of aluminum or an aluminum alloy and having a first thickness, rolling said sheet or strip down to a second thickness that is at least 6% smaller than said first thickness, conducting said rolling step with a roller having a surface treated or microroughened so that it imparts a microroughness surface to said sheet or strip comprising between about 10 cells and 250 cells per $mm^2$.

8. The process of claim 7 wherein said cells are in a honeycomb-like structure.

9. A method of manufacturing of a deep drawable, stretch-formable and ironable sheet or strip comprising of the following steps:

(a) providing an initial sheet or strip made of aluminum or an aluminum alloy and having a first thickness, (b) rolling down said initial sheet or strip without any intermediate steps by a roughened roll to a second thickness with the decrease in the thickness of said initial sheet of at least 6%, whereby a resulted microsurface of said sheet or strip has the micro roughness between 0.1 μm and 0.8 μm and a uniform, honey-comb-shaped structure is developed throughout the sheet or the strip.

10. A method according to claim 9 wherein the decrease of the thickness of said initial sheet is greater than 6%.

11. A method according to claim 9 wherein the initial sheet or strip is rolled down by the roll having a surface roughened by a concentrated corpuscular beam.

12. A method according to claim 11 wherein said corpuscular beam is a laser or an electron beam.

* * * * *